United States Patent [19]

Viland

[11] 4,286,392

[45] Sep. 1, 1981

[54] AUTOMATIC LOAD-ADJUSTING VENT CONTROL FOR FILM DRYERS

[75] Inventor: Michael G. Viland, Bloomington, Minn.

[73] Assignee: Pako Corporation, Minneapolis, Minn.

[21] Appl. No.: 117,501

[22] Filed: Feb. 1, 1980

[51] Int. Cl.[3] ..... F26B 13/02

[52] U.S. Cl. ..... 34/47; 34/54; 34/155; 34/156

[58] Field of Search ..... 34/155, 156, 47, 54, 34/233

[56] References Cited

U.S. PATENT DOCUMENTS

| | | | |
|---|---|---|---|
| 3,718,983 | 3/1973 | Crowell | 34/156 |
| 3,758,960 | 9/1973 | McCreary et al. | 34/47 |

*Primary Examiner*—Larry I. Schwartz
*Attorney, Agent, or Firm*—John W. Adams

[57] ABSTRACT

An air-impingement film dryer having an automatic self-adjusting vent for controlling the intake air flow in response to the increased demand caused by the presence of film in the drying chamber.

4 Claims, 4 Drawing Figures

AUTOMATIC LOAD-ADJUSTING VENT CONTROL FOR FILM DRYERS

BACKGROUND OF THE INVENTION

In the past, dryers for large film sheets such as are used in lithograph or graphic arts processors have been relatively inefficient since relatively large amounts of fresh air are drawn into the dryer when the drying chamber is empty as well as when film is located therein. In the present invention the design of the air flow path and the air intake vent is such that a greater volume of fresh air is drawn into the path whenever film is present in the drying chamber, and only a minimal amount of fresh air is drawn into the drying chamber when empty.

SUMMARY OF THE INVENTION

In the present invention the introduction of fresh air into the air flow path is automatically increased by the presence, in the drying chamber, of a sheet of photographic film to be dried. When the drying chamber is empty, the air velocity past the air intake vent is relatively low, and the static pressure adjacent to the inside of the air vent is approximately the same as the ambient pressure, so that there is only a very slight flow of fresh air through the vent when the dryer chamber is empty. When a sheet of film is introduced into the dryer chamber, the air flow from the discharge ducts is required to flow around the outside periphery of the film before returning to the blower. This causes the air velocity passing the inside of the vent to increase substantially, and this causes a decrease in the static pressure at this point. When the static pressure decreases, fresh air is drawn in through the vent. The greater the size of the film sheets, the more the static pressure decreases. This increases the flow of fresh air through the vent. Since the fresh outside air is necessary to reduce the moisture content in the drying air and since this fresh air flow intake is automatically increased by the presence, in the drying chamber, of the sheet of film to be dried, the invention produces an automatic fresh air intake control and materially increases the drying performance and efficiency of the dryer unit.

DETAILED DESCRIPTION OF THE PREFERRED EMBODIMENT

Figure 1:
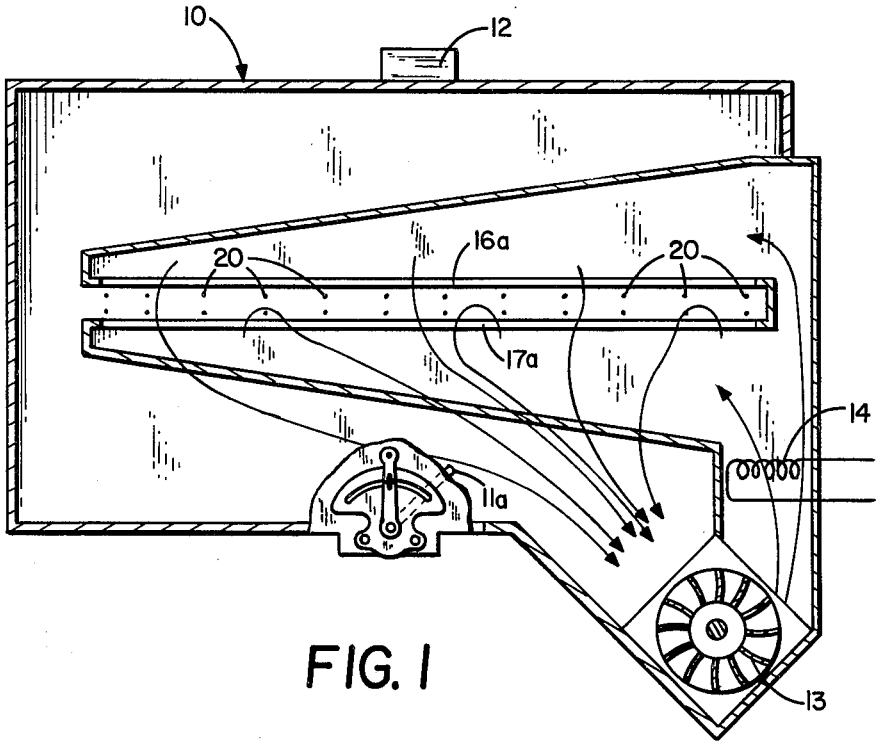
FIG. 1 is a transverse vertical sectional view taken substantially along the line 1—1 of FIG. 3 and showing the air flow with the drying chamber empty.

As illustrated in the accompanying drawings, this embodiment of the invention includes a dryer housing 10 having an air intake opening 11 and an air discharge opening 12. A blower 13 receives air from the lower portion of housing 10 including fresh air drawn in through intake opening 11 and discharges this air upwardly through suitable heating means such as the electric heating coil 14 located in the drying air flow path.

Figure 2:
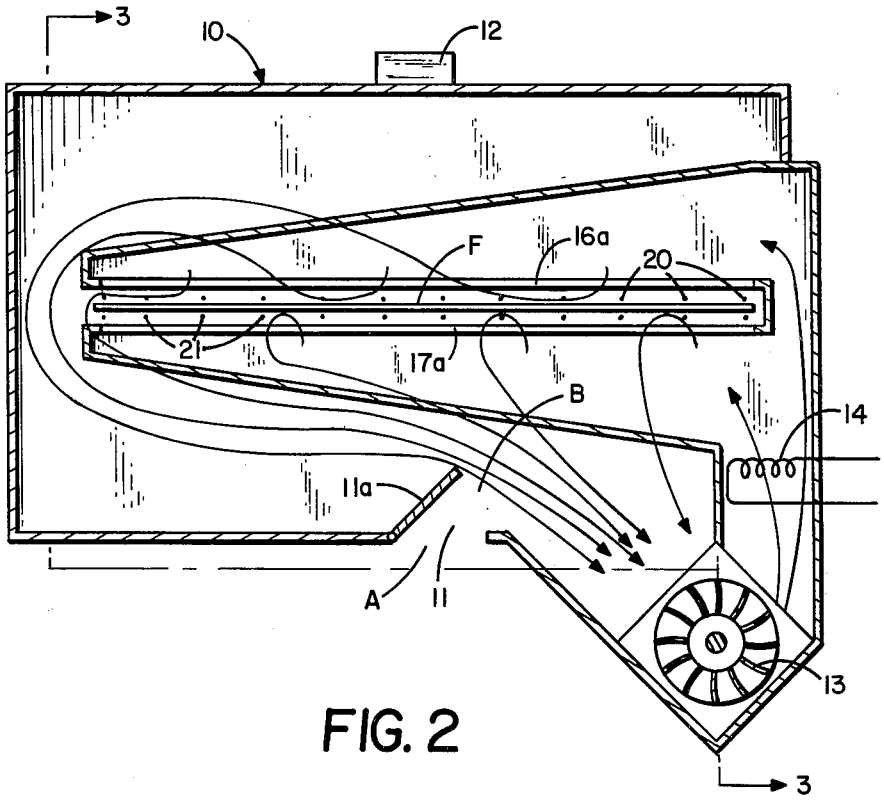
FIG. 2 is a similar view showing the air flow with a sheet of film being positioned in the drying chamber.
Figure 3:
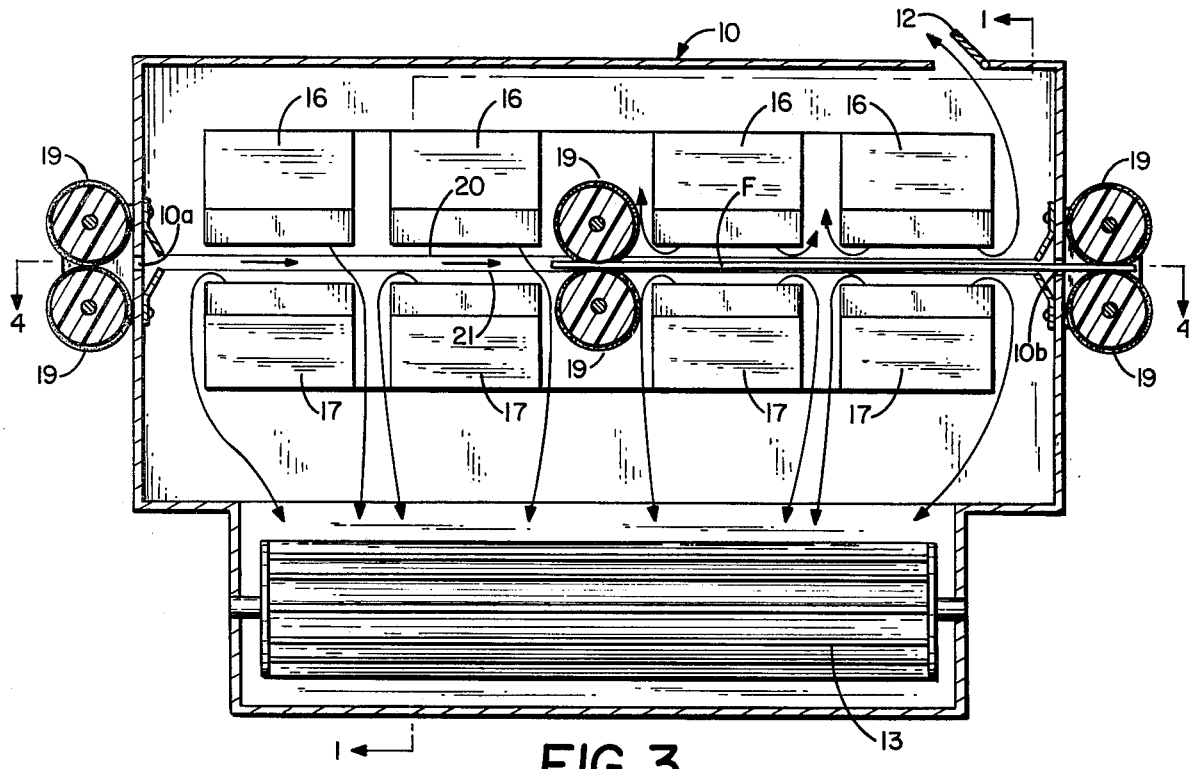
FIG. 3 is a sectional view taken substantially along the broken section line 3—3 of FIG. 2.
Figure 4:
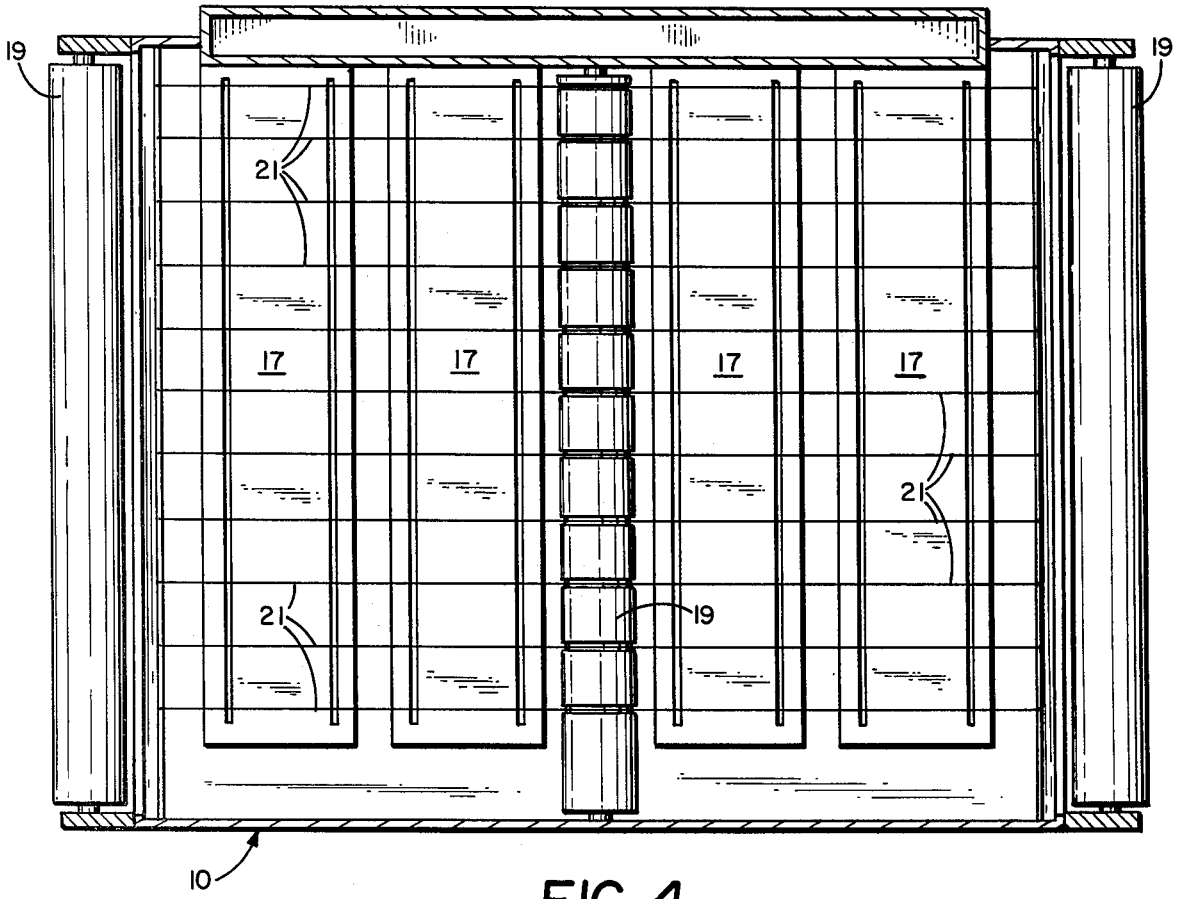
FIG. 4 is a horizontal sectional view taken substantially along the line 4—4 of FIG. 3 with the film sheet removed.

As shown in FIGS. 3 and 4, the dryer unit illustrated includes four pairs of hollow heating duct air-distribution heads. Each pair of heads includes an upper head 16 and a lower head 17 arranged in vertically spaced apart opposed relation so as to form an upper duct **16*a* and a lower duct 17*a*. The space between the two head elements provides a drying path for the sheets of film such as the sheet F shown in FIGS. 2 and 3. Housing 10 has a film entrance opening 10*a* and a film exit opening 10*b* at opposite ends of the drying path through said housing 10. Roller means 19 are provided to guide the film sheet F through the drying path. Two sets of guiding wires 20 and 21 run parallel to the line of travel of the film sheet F in the drying path, one of said sets being above said path, and the other set being therebelow. The bottom panels of the upper head elements 16 and the top panels of the lower elements 17 have air discharge slots to discharge air into the film drying path. As shown by the arrows in FIG. 1, the air follows a substantially unrestricted flow path after being discharged through the slotted heads 16 and 17 as it travels back to the intake of the rotary blower 13 when no sheet of film F is passing through the drying path of the unit. However, when a film sheet F is inserted into the drying path between the opposed pairs of head elements, the sheet F interrupts the flow of air directly from the upper head elements 16 to the lower portion of the housing 10 and causes the air to flow out around the periphery of the head elements as shown by the arrows in FIG. 2. This materially increases the velocity of the air flowing past the fresh air intake vent opening 11, which in turn reduces the static pressure in that area and increases the amount of fresh air drawn into the air flow path through said vent opening 11**.

Thus it will be seen that the pressure at B is substantially reduced by increases in the velocity of air flowing past vent opening 11 and fresh air will be drawn through the vent opening 11 according to the flow rate formula: $Q=VA=A\sqrt{2\Delta P/\rho}$ where $\Delta P=P_1=P_2$. In FIG. 2, $\Delta P=P_A-P_B$. Wider films will produce a greater intake of fresh air through the vent opening 11 than narrow films because of the greater restriction in the flow path between the air-distribution heads 16 and 17 thus producing an increase in the flow rate through the vent opening 11. A computation of drying performance can be made using the formula $K=(WBD\times\Delta M)/T$ where WBD is the web bulb depression (a measure of the amount of moisture in the air) and $\Delta M$ is the amount of moisture removed from the film and T is the time the film is positioned in the drying path between the two heads.

A suitable vent damper **11*a* is provided in the vent opening 11** to control the size of the opening. The following test results were obtained to indicate the variations in the percentage of fresh air drawn into the air flow pattern with no film present and with the widest possible (24 inches in the embodiment tested) with the various damper positions as indicated:

Dryer Vent Rate (% Fresh Air)

| Vent Position | No Film | 24" Film |
|---|---|---|
| closed | 0% | 4% |
| ¼ open | 0% | 12% |
| ⅜ open | 4% | 28% |
| ½ open | 6% | 40% |
| full open | 14% | 40% |

The 4% fresh air intake with the vent damper closed enters through the film openings at the ends of the housing and through other leakage areas of the housing.

From the foregoing disclosure, it will be seen that materially improved efficiency in the drying operation will be obtained by the dryer unit embodying this invention. This increased efficiency is produced by the fact that a minimum of outside air is drawn through the intake vent opening 11 when film is not being transported through the drying path, thus producing a maximum recirculation of the air and a minimum of additional heat supplied thereto. However when a sheet of film F is inserted into the drying path, the intake of fresh air is substantially increased to reduce the moisture content of the drying air and the drying time will thus be maintained at a minimum. It should also be pointed out that the larger the sheet being dried, the greater the intake of fresh relatively dry outside air.

It will, of course, be understood that various changes may be made in the form, details, arrangement, and proportions of the parts disclosed, without departing from the scope of this invention.

What is claimed is:

1. A dryer for photographic film sheets having a vent for automatically controlling the intake of outside air, said dryer comprising:

a housing defining a film drying chamber with an outside air intake vent and an air discharge opening and also having film entrance and film exit openings, means defining a film drying path through said chamber with the entrance at one end and the exit at the other, means for transporting said sheets of film through said film drying path, from the film entrance opening through the film exit opening, at least two air-distribution heads respectively disposed on opposite sides of said drying path, each head being a hollow chamber having air discharge openings directing air toward the film drying path, an air blower located within the housing and provided with an air intake to receive the air discharged from said heads, the air stream following a first flow pattern directly from both heads to the blower intake when the drying chamber is empty and a second flow pattern around the film sheet when the drying chamber contains a sheet of film to be dried, said second flow pattern producing less static pressure at the air vent than the first flow pattern to increase the intake of outside air only when film to be dried is located in said drying chamber, said chamber air intake vent being positioned in the portion of the air stream located between the drying path and the blower intake, passage means for delivering the air discharged from said blower into the air-distribution heads, and heating means located in the flow path of the drying air.

2. The structure of claim 1 wherein a damper is provided at said air intake to control the flow of air through said intake opening.

3. The structure of claim 1 wherein roller means are provided in said drying path to transport the film through the film drying chamber.

4. The structure of claim 1 wherein two sets of guiding wires run parallel to the line of travel of the film in the film drying path, one set being above the path and the other being therebelow, to keep the film flat during the travel of the film sheets through the drying chamber.

* * * * *